US008046934B2

(12) United States Patent
Lenoir

(10) Patent No.: US 8,046,934 B2
(45) Date of Patent: Nov. 1, 2011

(54) CONVECTIVE SYSTEM FOR A DRYER INSTALLATION

(75) Inventor: Patrick Lenoir, Villeneuve d'Ascq (FR)

(73) Assignees: NV Bekaert SA, Zwevegem (BE); Bekaert Combustion Technology B.V., Ar Assen (NL)

( * ) Notice: Subject to any disclaimer, the term of this patent is extended or adjusted under 35 U.S.C. 154(b) by 755 days.

(21) Appl. No.: 12/162,030

(22) PCT Filed: Jan. 24, 2007

(86) PCT No.: PCT/EP2007/050693

§ 371 (c)(1),
(2), (4) Date: Jul. 24, 2008

(87) PCT Pub. No.: WO2007/085618

PCT Pub. Date: Aug. 2, 2007

(65) Prior Publication Data

US 2009/0031581 A1 Feb. 5, 2009

(30) Foreign Application Priority Data

Jan. 25, 2006 (EP) ..... 06100857
Jan. 31, 2006 (EP) ..... 06101071

(51) Int. Cl.
*F26B 9/00* (2006.01)

(52) U.S. Cl. ..... 34/613; 34/617; 34/623; 34/631; 34/635; 162/207; 162/290; 73/23.37; 73/23.41; 451/259; 51/293; 502/400; 502/60; 266/192; 266/84

(58) Field of Classification Search ..... 34/611, 34/612, 613, 615, 617, 631, 635; 162/207, 162/290; 266/192, 84; 451/259; 73/23.37, 73/23.41; 51/293; 502/400
See application file for complete search history.

(56) References Cited

U.S. PATENT DOCUMENTS 2,668,700 A * 2/1954 Zimmerman ..... 432/42
(Continued)

FOREIGN PATENT DOCUMENTS

AU 420 345 7/1969
(Continued)

*Primary Examiner* — Stephen Gravini
(74) *Attorney, Agent, or Firm* — Foley & Lardner LLP

(57) ABSTRACT

The present invention concerns a convective system for a dryer installation for a passing web, more particularly paper. The convective system 7 is an assembly of an exterior casing 13 for suction of combustion products with opening 14 towards the web, with a first 15 and second 16 suction ducts sucking the combustion products into the convective system 7. The combustion products coming from the first suction duct 15 are guided through the exterior casing 13 to a mixing and blowing device 17. Cold air 18 is mixed in this mixing and blowing device 17 with the combustion products 19, resulting in a gas mixture with lower temperature 20. The convective system 7 also has an internal casing 21 inside the external casing 13. This internal casing 21 has at least one opening towards the web 22 and has also openings 34 allowing gas flow from the mixing device 17 to the internal casing 21 of said gas mixture 20. Under the internal casing 21, there is also a blowing duct 23. The second suction duct 16 is also arranged under this internal casing 21 thereby extracting a second flow of combustion products 24 into the internal casing 21. This second flow 24 of combustion products is then mixed with the gas mixture 20 coming from the mixing device 17, resulting in a mixture of gasses 25 with a temperature that is higher than the first gas mixture 20 and higher than e.g. 350° C. or 370° C., more preferably 390° C. or 410° C., even more preferably 420° C., 450° C. or 500° C. These hot gasses 25 are then blown to the drying web by the blowing duct 23 of the internal casing 21.

13 Claims, 4 Drawing Sheets

U.S. PATENT DOCUMENTS

| | | | | |
|---|---|---|---|---|
| 2,987,305 | A * | 6/1961 | Calhoun, Jr. | 432/31 |
| 3,096,162 | A * | 7/1963 | Jepson | 34/502 |
| 3,231,985 | A * | 2/1966 | Smith, Jr. | 34/448 |
| 3,416,237 | A * | 12/1968 | Sutherland et al. | 34/446 |
| 3,590,495 | A * | 7/1971 | Tyson et al. | 34/654 |
| 3,643,342 | A * | 2/1972 | Tyson et al. | 34/555 |
| 3,744,963 | A * | 7/1973 | Flynn | 432/59 |
| 4,094,627 | A * | 6/1978 | Milton, Jr. | 432/59 |
| 4,290,269 | A * | 9/1981 | Hedstrom et al. | 60/670 |
| 4,622,758 | A * | 11/1986 | Lehtinen et al. | 34/392 |
| 4,726,124 | A * | 2/1988 | Freiberg | 34/79 |
| 5,069,801 | A * | 12/1991 | Girovich | 210/770 |
| 5,105,558 | A * | 4/1992 | Curry | 34/449 |
| 6,085,437 | A * | 7/2000 | Stipp | 34/115 |
| 6,088,930 | A | 7/2000 | Robin et al. | |
| 6,264,791 | B1 * | 7/2001 | Sun et al. | 162/168.1 |
| 6,308,436 | B1 * | 10/2001 | Stipp | 34/422 |
| 6,393,719 | B1 * | 5/2002 | Stipp | 34/115 |
| 6,432,267 | B1 * | 8/2002 | Watson | 162/111 |
| 6,470,597 | B1 * | 10/2002 | Stipp | 34/422 |
| 6,511,015 | B1 | 1/2003 | Heikkilä et al. | |
| 6,553,689 | B2 * | 4/2003 | Jain et al. | 34/444 |
| 6,560,893 | B1 * | 5/2003 | Bakalar | 34/110 |
| 6,694,639 | B2 * | 2/2004 | Hanaya | 34/115 |
| 7,189,307 | B2 * | 3/2007 | Goulet et al. | 162/127 |
| 7,229,529 | B2 * | 6/2007 | Goulet et al. | 162/127 |
| 7,297,231 | B2 * | 11/2007 | Goulet et al. | 162/168.1 |
| 7,566,381 | B2 * | 7/2009 | Goulet et al. | 162/164.3 |
| 7,678,228 | B2 * | 3/2010 | Goulet et al. | 162/112 |
| 7,891,973 | B2 * | 2/2011 | Lenoir | 431/328 |
| 7,918,038 | B2 * | 4/2011 | Miller et al. | 34/445 |
| 7,918,040 | B2 * | 4/2011 | Lenoir | 34/630 |
| 7,926,200 | B2 * | 4/2011 | Lenoir | 34/266 |
| 7,971,370 | B2 * | 7/2011 | Miller et al. | 34/445 |
| 2002/0095818 | A1 * | 7/2002 | Jain et al. | 34/448 |
| 2003/0019125 | A1 * | 1/2003 | Hanaya | 34/114 |
| 2003/0230003 | A1 * | 12/2003 | Miller et al. | 34/444 |
| 2004/0231685 | A1 * | 11/2004 | Patel et al. | 131/365 |
| 2004/0238136 | A1 * | 12/2004 | Patel et al. | 162/139 |
| 2005/0000113 | A1 * | 1/2005 | Freiberg | 34/611 |
| 2005/0045294 | A1 * | 3/2005 | Goulet et al. | 162/109 |
| 2005/0045295 | A1 * | 3/2005 | Goulet et al. | 162/109 |
| 2005/0076929 | A1 * | 4/2005 | Fitzgerald et al. | 131/365 |
| 2006/0179680 | A1 * | 8/2006 | Miller et al. | 34/444 |
| 2006/0191160 | A1 * | 8/2006 | Miller et al. | 34/444 |
| 2007/0187056 | A1 * | 8/2007 | Goulet et al. | 162/164.3 |
| 2007/0193060 | A1 * | 8/2007 | Lenoir | 34/273 |
| 2008/0006381 | A1 * | 1/2008 | Goulet et al. | 162/168.1 |
| 2008/0006382 | A1 * | 1/2008 | Goulet et al. | 162/168.1 |
| 2008/0209759 | A1 * | 9/2008 | Shivvers | 34/514 |
| 2008/0256818 | A1 * | 10/2008 | Lenoir | 34/60 |
| 2009/0007453 | A1 * | 1/2009 | Robin et al. | 34/611 |
| 2009/0031581 | A1 * | 2/2009 | Lenoir | 34/611 |
| 2010/0206505 | A1 * | 8/2010 | Clarahan et al. | 162/207 |
| 2011/0035958 | A1 * | 2/2011 | Gissing et al. | 34/427 |

FOREIGN PATENT DOCUMENTS

| | | | |
|---|---|---|---|
| DE | 3148321 | A1 * | 8/1983 |
| DE | 3920078 | A1 * | 12/1989 |
| DE | 19752562 | A1 * | 4/1999 |
| DE | 102006058710 | A1 * | 6/2008 |
| EP | 126221 | A2 * | 11/1984 |
| EP | 326227 | A1 * | 8/1989 |
| EP | 346041 | A2 * | 12/1989 |
| EP | 346042 | A2 * | 12/1989 |
| EP | 869323 | A2 * | 10/1998 |
| EP | 925880 | A2 * | 6/1999 |
| EP | 990867 | A2 * | 4/2000 |
| EP | 1182413 | A1 * | 2/2002 |
| EP | 1515103 | A2 * | 3/2005 |
| FR | 2 771 161 | A1 | 5/1999 |
| JP | 59213919 | A * | 12/1984 |
| JP | 60119327 | A * | 6/1985 |
| JP | 63187017 | A * | 8/1988 |
| JP | 01321994 | A * | 12/1989 |
| JP | 02039939 | A * | 2/1990 |
| JP | 03023322 | A * | 1/1991 |
| JP | 06257061 | A * | 9/1994 |
| JP | 11239983 | A * | 9/1999 |
| JP | 2001081657 | A * | 3/2001 |
| JP | 2004130506 | A * | 4/2004 |
| WO | WO 2005/085729 | A2 | 9/2005 |

* cited by examiner

CONVECTIVE SYSTEM FOR A DRYER INSTALLATION

TECHNICAL FIELD

The present invention concerns a convective system for a dryer installation for a passing web, more particularly paper.

BACKGROUND ART

There exists e.g. according to FR-A-2771161 in the name of the applicant an installation having at least a web, gas-heated radiant elements arranged according to at least one row stretching out in the transversal direction of the web, substantially over its entire width, and, downstream at least one row of radiant elements, at least a transverse convective system equipped with suction and blowing devices to suck at least part of the combustion products produced by the radiant elements and to blow this part of the combustion products towards the web. The installation generally also has devices to extract the warm gasses resulting from the convective exchanges between the passing web and the combustion products.

The suction and blowing devices have a mixing device, such as e.g. a ventilator, that is, for several known reasons, shifted laterally at the outside of the web, in relation to the median longitudinal axis usually at a large, even extremely large, distance in relation to the width of the web. In that way, the ventilator has to laterally collect the combustion products that are initially divided over the entire width of the web, mix the combustion products and divide them again over the entire width of the web. Such a mixing entails an important consumption of energy.

In addition, such an installation has suction and blowing ducts that, at least in the transverse direction of the web, have an important size. These ducts dissipate thermal energy by radiation and convection. There is amongst other things aspiration of cold air that is cooling down the combustion products. Hence, the temperature of the combustion products blown on the web is considerably lower than the temperature of the combustion products generated by the radiant elements.

Such an installation, although functioning satisfactorily, thus implies a considerable consumption of mechanical energy and also a considerable loss of thermal energy, thus resulting in considerable investment and operating costs, and also occupies a large surface. An already improved system has been described in WO 2005/085729 in the name of the applicant resulting in a reduced consumption of mechanical energy and a reduced loss of thermal energy, lower investment and operation costs, and necessitating less space. This dryer installation is characterized by the fact that the suction and blowing devices of the convective system have at least one suction and blowing device installed opposite of the passing web in relation to corresponding suction and blowing ducts that at least stretch out in the transverse direction of the web, and arranged so as to suck and/or blow the said combustion products in such a way that the vector averages are optimized. The vectors are representing the respective trajectories of the different jets of sucked and/or blown combustion products. This optimization considerably reduces the trajectories of the jets of combustion products and the mechanical mixing energy needed to suck and blow the different jets of combustion products. These shorter trajectories of combustion products require shorter suction and blowing ducts and smaller dimensions corresponding to smaller surfaces that lead to considerably smaller losses of thermal energy by radiation and convection.

Likewise, the temperature difference between the sucked combustion products and the blown combustion products is substantially reduced, thereby increasing the efficiency.

In that way, the thermal transfers between the combustion products and the passing plane can be maximized, and it is also possible to obtain an extremely compact dryer installation in which the combustion products are blown at the highest possible temperature.

Although above described system has already improved the efficiency of the dryer installation to a large extent, there is still a major restriction to the system in that the mixing devices cannot withstand temperatures that are higher than e.g. 350° C., thereby limiting the temperature of the warm blown combustion products.

SUMMARY OF THE INVENTION

The objective of the present invention is to mitigate the restrictions of the known installations and to propose a convective system for a dryer installation having a more reduced consumption of mechanical energy and a more reduced loss of thermal energy and lower investment and operation costs. A further objective of the present invention is to accomplish an improvement within existing systems and within the existing dimensions. Still another objective of the present invention is to accomplish an improvement by means of simple measures.

According to a first aspect of the invention, there is provided a convective system for a dryer installation arranged transversely with respect to a web to be dried. The convective system is an assembly of an exterior casing for suction of combustion products with opening towards the web, with a first and second suction ducts sucking the combustion products into the convective system. The combustion products coming from the first suction duct are guided through the exterior casing to a mixing and blowing device. Cold air is mixed in this mixing and blowing device with the combustion products, resulting in a gas mixture with lower temperature.

The convective system also has an internal casing inside the external casing. This internal casing has at least one opening towards the web and has also openings allowing gas flow from the external casing to the internal casing of said gas mixture. Under the internal casing, there is also a blowing duct. The second suction duct is also arranged under this internal casing thereby extracting a second flow of combustion products into the internal casing. This second flow of combustion products is then mixed with the gas mixture with lower temperature coming from the mixing device, resulting in a mixture of gasses with a temperature that is higher than the first gas mixture and higher than e.g. 350° C., more preferably 400° C. or 450° C., even more preferably 500° C. These hot gasses are then blown to the drying web by the blowing duct of the internal casing.

Also according to the invention this improved convective system can be achieved by simple means, by applying an inner casing into the outer casing. It is clear that applying an inner casing can be done without difficulties, thus in a simple way.

Applying an inner casing can be realized both in a completely new convective system and in an existing convective system without changing drastically the dimensions.

This direct re-use of hot combustion products in the internal casing increases the temperature of the blown gasses resulting in a more efficient use of the heat produced by the dryer system and improving the efficiency of the heat exchange in the system.

According to an alternative version of the invention, the convective system is constructed with a mixing and blowing device being a venturi-system.

According to another version of the invention, the convective system is designed in such a way that the blowing duct is arranged between said first suction duct and said second suction duct.

A preferable embodiment of the invention provides a special design of the internal casing resulting in a good air distribution.

Another preferred embodiment of the invention provides in the system an air pressure sensor in order to assure constant flotation effect on the web to be dried. A temperature sensor can also be foreseen.

A preferred embodiment of the invention is the convective system wherein the mixing and blowing device at least has one turbine of which the axis is perpendicular to the web. Another version of the invention is the convective system wherein the mixing and blowing device at least has one turbine of which the axis is parallel to the web.

According to a second aspect, the invention provides a method for safeguarding a fan from contact with hot combustion gasses by using above described convective system.

According to a third aspect, the invention provides a method of re-using heated gasses to enhance the heat exchanging efficiency using the above described convective system.

Above described convective system can then be used in a dryer installation for drying a web, e.g. paper. The dryer installation is designed for drying a maximum web width and is composed of gas-heated radiant elements for radiating said web next to the convective system. The radiant elements are arranged in at least one row stretching out in the transversal direction over the substantially entire maximum web width. A further implementation of the invention is an installation which has at least two transverse convective systems arranged one after the other in the passing direction of the web and separated one from the other by at least one transverse row of gas-heated radiant elements.

In the same way can the above described convective system be used in a dryer installation based on a burner assembly, said dryer installation e.g. being of a flame drier type.

In an even more preferred embodiment of the invention the system of re-using the exhaust gases is set up in a cascade system, wherein the exhaust gasses coming directly from the heating assembly (e.g. burner system, gas-heated radiant elements) are sucked and blown to the web by a first convective system. The warm gasses which are then available at the second convective system are again sucked for re-use and re-blown thereby making further use of the available thermal energy which was created by the heating assembly. For example, first there is the heating assembly with temperatures over 1000° C. thereafter a first convective system which blows re-used exhaust gasses at 400° C. and thereafter a second convective system which blows gasses at 200° C. This further increases the drying efficiency of the system.

One can even consider putting one of above described installations on each side of the web to be dried.

BRIEF DESCRIPTION OF DRAWINGS

The invention will now be described into more detail with reference to the accompanying drawings wherein.

Figure 1:
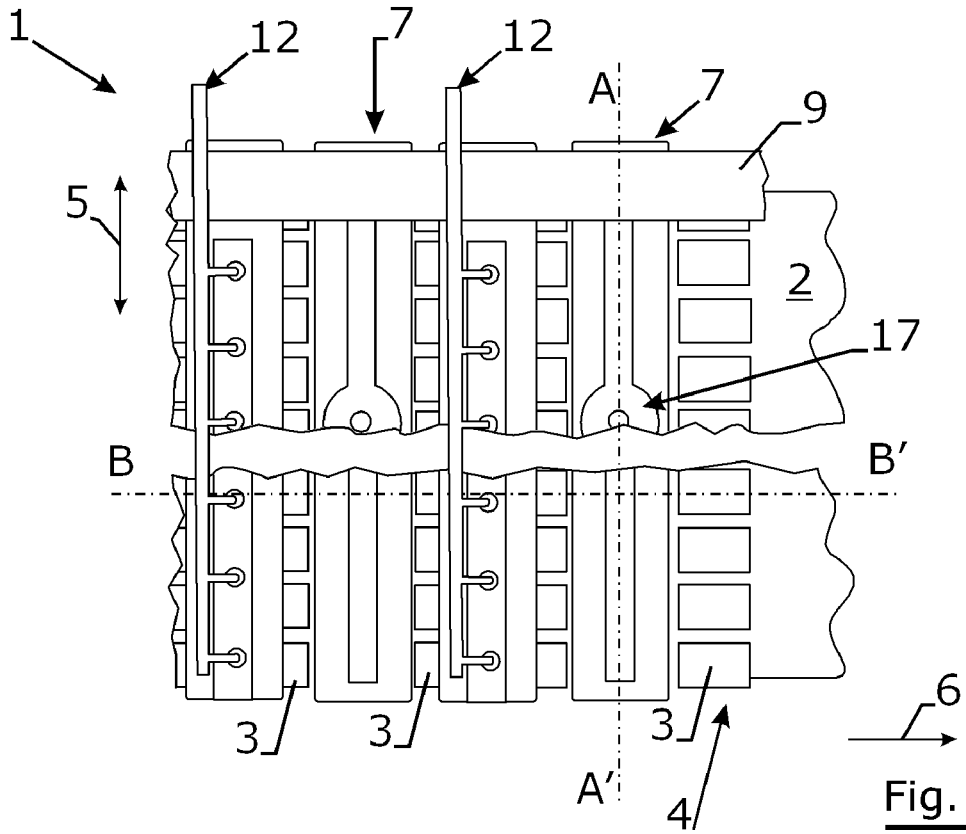
FIG. 1 is a schematic view of a dryer system

REFERENCE LIST OF USED NUMBERS IN THE FIGURES dryer installation 1
passing web 2
gas-heated radiant elements 3
one row of gas-heated radiant elements 4
transverse direction arrow 5
passing direction of the web 6
convective system 7
suction and blowing devices 8
devices to extract the warm gasses resulting from the convective thermal exchanges,
Arrow 9
gas supply tubes 10
combustion air supply tubes 11
air/gas alimentation 12
exterior casing 13
opening towards the web 14
first suction duct 15
second suction duct 16
a mixing and blowing device 17
Fresh cold air 18
combustion products 19
gas mixture with lower temperature 20
internal casing 21
opening in internal casing towards the web 22
blowing duct 23
a second flow of combustion products 24
mixture of gasses with t° higher than from (20) 25
extraction duct 26
cylindrical rotor 27
corresponding enclosed space for cylindrical rotor 28
axis of the rotor 29
turbine 30 axis of turbine 31
suction opening of turbine 32
tangential outlet opening of turbine 33
openings allowing gas flow from the mixing device 17 to the internal casing 34
burner assembly 35

DESCRIPTION OF THE PREFERRED EMBODIMENTS OF THE INVENTION

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

FIG. 1 represents a dryer installation 1 for a passing web 2, more particularly paper, e.g. for a web of coated paper that has been treated in a humid way and has to be dried without contact.

The installation 1 has at least the web 2 and the gas-heated radiant elements 3. The elements 3 are arranged according to at least one row 4 stretching out in the transversal direction 5 of the web 2. The row 4 substantially stretches over the entire maximum web width.

The installation 1 also has at least one convective system 7 downstream of at least one row 4 of radiant elements 3, referring to the direction of the passing of the web 6. The convective system includes suction and blowing devices 8. The devices 8 suck at least a part of the combustion products generated by the radiant elements 3 and blow those combustion products towards the web 2. The convective system also has devices 9 to extract the warm gasses resulting from the convective thermal exchanges between the passing web 2 and those combustion products.

The radiant elements 3 can be gas-heated radiant elements of whatever type, arranged in any possible way in relation to one another and in relation to gas supply tubes, and to combustion air supply tubes.

According to the present invention, the suction and blowing devices 8 include at least one mixing device 12 installed opposite of the passing web 2.

Figure 2:
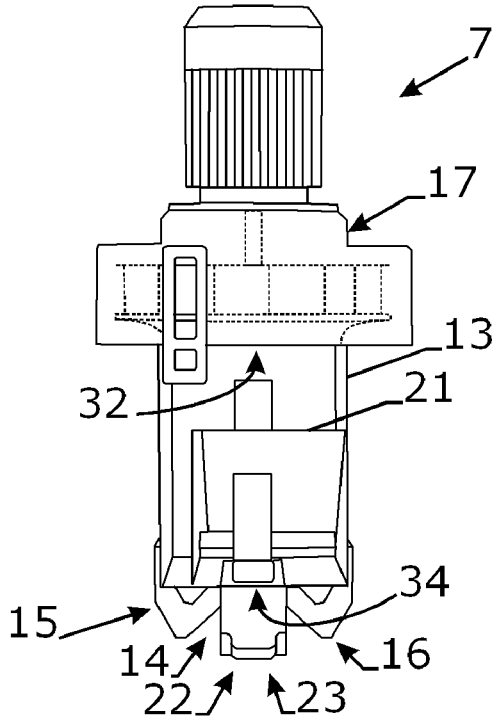
FIG. 2 is a cross-section of a convective system according to a plane B-B' that stretches out in the longitudinal direction of a web and that is perpendicular to the direction of the movement of the web, showing the structure of the convective system.

FIG. 2 represents a section of the convective system 7 according to a plane perpendicular to the web that stretches out in the longitudinal direction of the web (according to B-B').

Figure 3A:
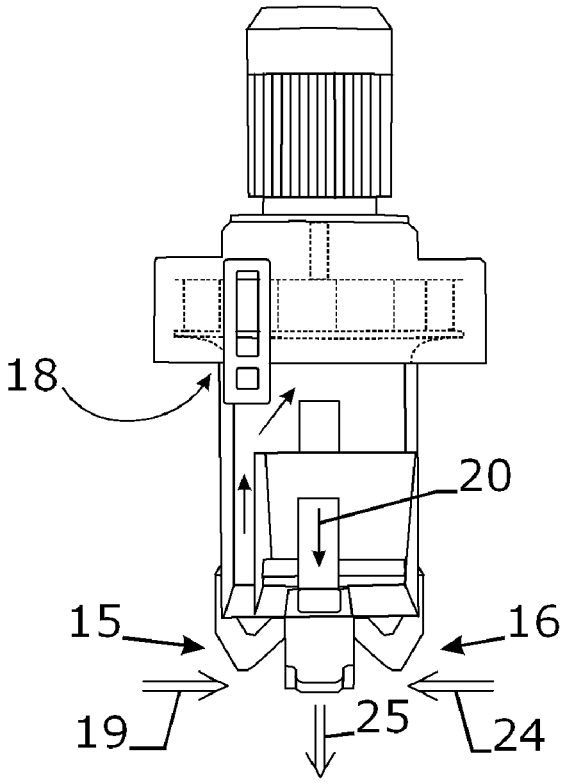
FIG. 3*a* is a cross-section of a convective system according to a plane B-B' that stretches out in the longitudinal direction of a web and that is perpendicular to the direction of the movement of the web, showing the respective gas flows occurring in a first step of the convective system with respect to the moving direction of the web.

FIG. 3*a* shows the respective gas flows in the convective system with a first suction duct 15 with respect to the moving direction of the web.

Figure 3B:
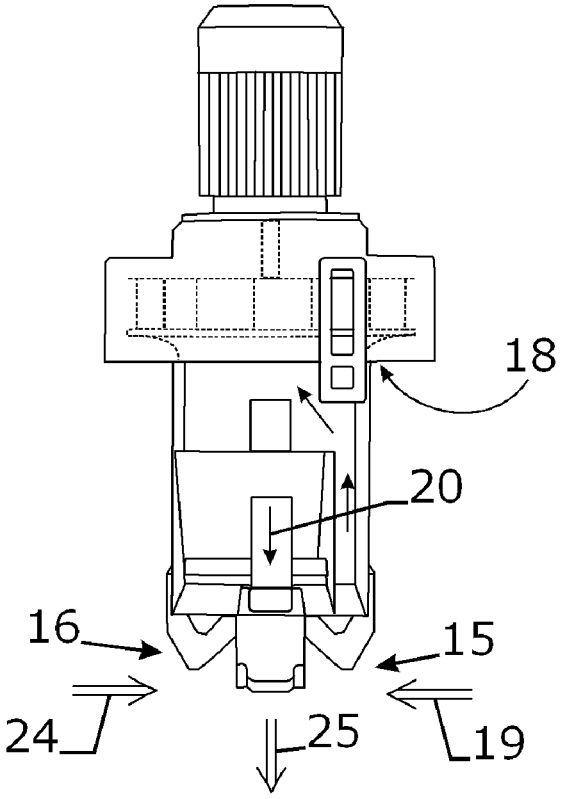
FIG. 3*b* is a cross-section of a convective system according to a plane B-B' that stretches out in the longitudinal direction of a web and that is perpendicular to the direction of the movement of the web, showing the respective gas flows occurring in an alternative setup of the convective system with respect to the moving direction of the web.

FIG. 3*b* shows an alternative setup of the convective system with regard to the moving direction of the web.

Reference is made to FIG. 2 and FIG. 3A. The convective system 7 is an assembly of an exterior casing 13 for suction of combustion products with opening 14 towards the web, with a first 15 and second 16 suction ducts sucking the combustion products into the convective system 7. The combustion products coming from the first suction duct 15 are guided through the exterior casing 13 to a mixing and blowing device 17. Cold air 18 is mixed in this mixing and blowing device 17 with the combustion products 19, resulting in a gas mixture with lower temperature 20. The convective system 7 also has an internal casing 21 inside the external casing 13. This internal casing 21 has at least one opening towards the web 22 and has also openings 34 allowing gas flow from the mixing device 17 to the internal casing 21 of said gas mixture 20. Under the internal casing 21, there is also a blowing duct 23. The second suction duct 16 is also arranged under this internal casing 21 thereby extracting a second flow of combustion products 24 into the internal casing 21. This second flow 24 of combustion products is then mixed with the gas mixture 20 coming from the mixing device 17, resulting in a mixture of gasses 25 with a temperature that is higher than the first gas mixture 20 and higher than e.g. 350° C. or 370° C., more preferably 390° C. or 410° C., even more preferably 420° C., 450° C. or 500° C. These hot gasses 25 are then blown to the drying web by the blowing duct 23 of the internal casing 21. FIG. 3B depicts an alternative embodiment following the same principle as in FIG. 3A.

Figure 4:
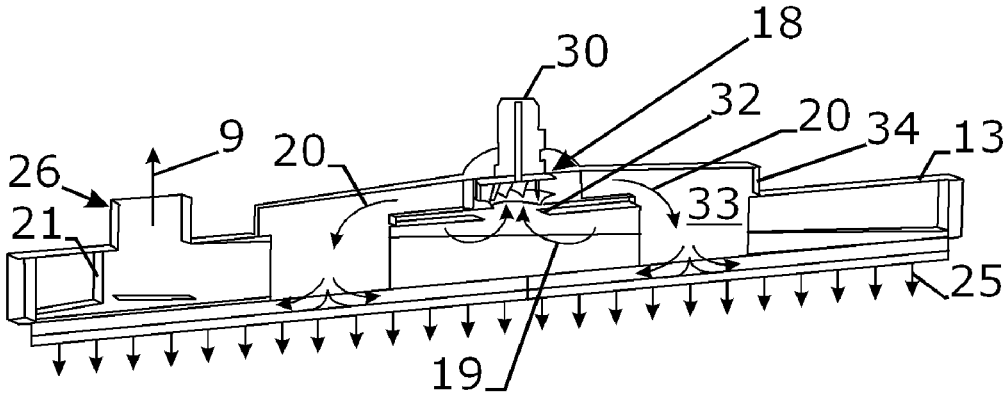
FIG. 4 is a cross-section of a convective system according to a plane A-A' that stretches out in the transverse direction of the web and that is perpendicular to the direction of the movement of the web.

FIG. 4 is a cross-section, according to a plane perpendicular to the web 2 that stretches out in the transverse direction of the web (according to A-A'), of the convective system 7. The suction ducts 15 and 16 and blowing duct 23 stretch out over the total web width, but are not indicated in this figure. In order to achieve a good three-dimensional air distribution in the inner duct 21, the convective system 7 can preferably be designed as indicated in FIG. 4. The internal casing 21 comprises also an extraction duct 26 that is part of the devices 9. The extraction duct 26 extracts part of the warm gasses 25 and part of the combustion gasses 19. This extraction duct 26 is asymmetrically arranged in the convective system 7. In order to obtain a good air blowing distribution, the inner height of the internal casing 21 is also asymmetric and increases towards the extraction duct 26. The devices 9 are known extraction devices, e.g. a fan.

In the represented example, each turbine 30 has a centrifugal turbine wheel of which the suction opening 32 is connected to an upstream transverse suction duct 15 in relation to the web 2. The wheel is driven by an engine, as in any conventional fan.

The mixed gasses 20 are blown through two tangential outlet openings 33 substantially directly opposite to the transverse direction 5 of the web 2, and connected to two transversal blowing ducts 34.

Figure 5:
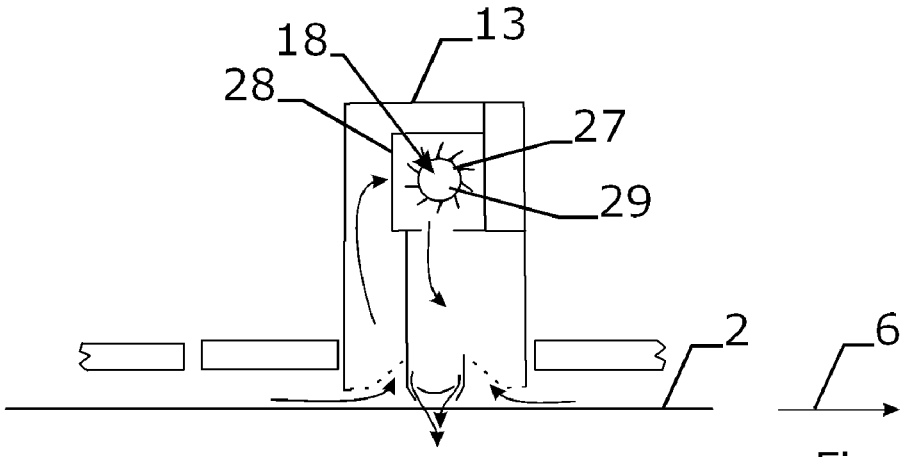
FIG. 5 is a cross-sectional view of another realization method of the present invention.

FIG. 5 shows another preferred embodiment of the invention. Here, the mixing and blowing device of the convective system has at least one turbine of which the axis is parallel to the web. A cylindrical rotor 27 is installed at the interior side of the first external casing 13. Each cylindrical rotor 27 is installed inside a corresponding enclosed space 28 and has radial blades. Each cylindrical rotor 27 turns around a respective axis 29 parallel to the web 2 and substantially perpendicular to the passing direction 6 of the web 2.

In the represented example, the different rotors 27 are installed on the same pole driven by an engine.

Another preferred embodiment of the invention is a convective system 7 wherein the mixing and blowing device at least has one turbine of which the axis is perpendicular to the web, as in e.g. a fan. This axis can also be given other directions inclined in any possible direction in relation to the web, without leaving the scope of the present invention.

Figure 6:
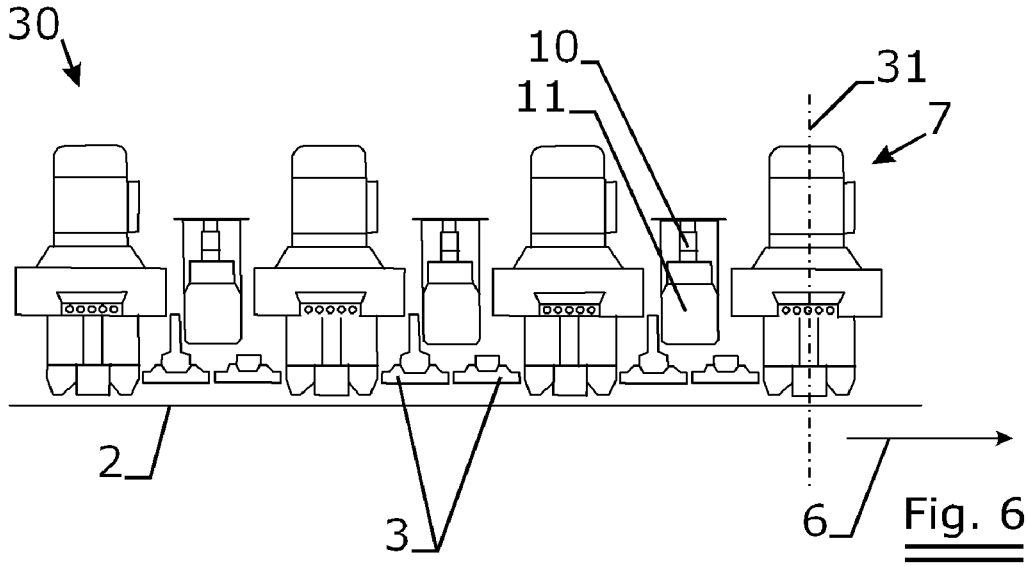
FIG. 6 is a cross-sectional view of a dryer installation according to a first realization mode of the present invention.
Figure 7:
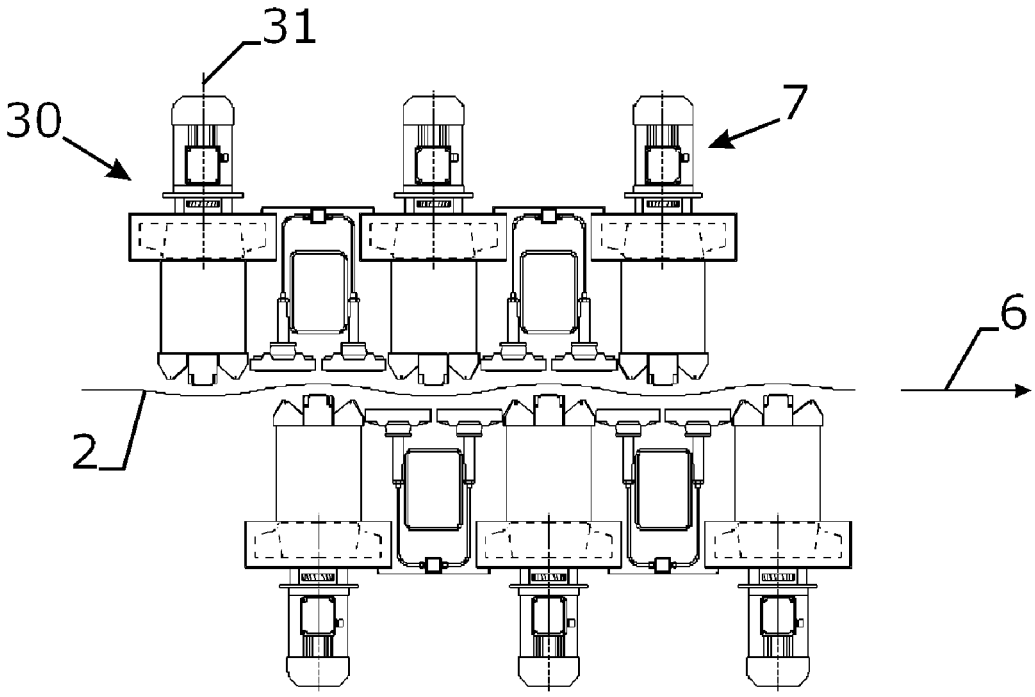
FIG. 7 is a schematic cross-sectional view of a dryer installation according to another realization mode of the present invention.

In the realization mode of FIGS. 6 and 7, each convective system 7 at least has one turbine 30 of which the axis 31 is substantially perpendicular to the web 2.

Each convective system can have a fresh air inlet opening, along a lateral edge of the web 2, for instance in the right-hand side of FIG. 4. This fresh air inlet is advantageously closed off by a valve to allow the entrance of ambient temperature air inside the suction duct 15 in order to dilute the combustion products and thus limit the temperature of the combustion products sucked by turbine 30, if necessary.

In addition, each convective system 7 also has an extraction opening as described above.

Another preferred embodiment of the invention is a convective system wherein the mixing device 12 is an organ adapted to blow air under pressure through the openings 33 of FIG. 4. This creates a venturi effect which sucks at least part of the combustion products through the suction duct 15 and blows them in the internal casing 21.

Obviously, the present invention is not limited to the realization modes described above, and many changes and modifications can be made to these realization modes without leaving the scope of the present invention.

One can of course use any mixing device adapted to suck and blow the combustion products, and arrange these mixing devices and the corresponding suction and blowing ducts in any known way.

The afore-described mixing devices can also be arranged in a different way than the ways described above.

These mixing devices and the corresponding transversal convective systems can be linked to gas-heated radiant elements of any type, and these radiant elements can be arranged in any possible way.

These mixing devices and the corresponding transversal convective systems can in the same way be linked to gas-heated burners elements of any type, e.g. a blue flame burner, and these burner elements can be arranged in any possible way.

As schematized in FIGS. 1, 6 and 7, one can foresee at least two convective systems 7 according to the present invention, arranged one after the other in the passing direction 6 of the web 2 and separated from one another by at least one transversal row 4 of gas-heated radiant elements. According to FIG. 7, an arrangement of such radiant elements and convective systems can be put on each side of the web to be dried.

Obviously, the devices of the invention described above, the suction ducts 15 and 16 and the blowing duct 23, the mixing devices 30, the exterior 13 and interior casing 21, etc. are designed and arranged in a known way so that they can endure durably and reliably the high temperatures of the sucked and/or blown combustion products.

Figure 8:
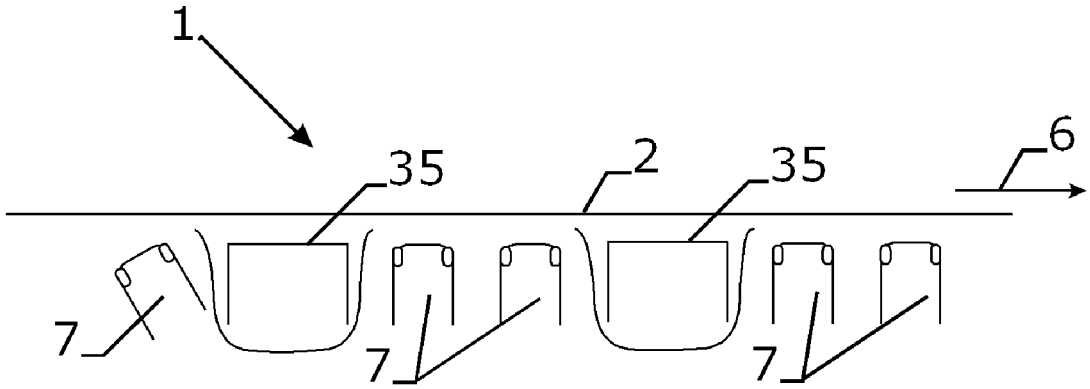
FIG. 8 is a schematic cross-sectional view of a flame dryer installation according to an alternative realisation mode of the present invention.

As schematised in FIG. 8 one can foresee at least two convective systems according to the present invention, arranged one after the other in the passing direction of the web 2, in a drier installation. In this so called cascade system, the exhaust gases are coming directly from a burner assembly, and are sucked by the convective system whereafter these hot gasses are blown to the web for re-use, by the blowing duct. The warm gasses which are then available at the convective system can again be sucked for re-use and reblown thereby making further use of the available thermal energy which was created by the burner assembly. For example, first there is the burner assembly with temperatures over 1000° C. thereafter a first convective system which blows reused exhaust gasses at 400° C. and thereafter a second convective system which blows gasses at 200° C. This cascade system of re-using the created hot-air flows can also be used in other drying systems, e.g. in combination with IR-dryers.

Obviously, it is also possible to foresee, in addition, thermal insulation devices and/or traditional cooling-down devices known to protect certain specific devices, such as e.g. an electrical engine.

We have thus described and represented a convective system for use in a dryer installation designed and arranged to limit as much as possible thermal losses in order to maintain the high energy potential of these combustion products and thus allow an excellent return of the convective thermal exchanges between the web and the sucked and blown combustion products.

In addition to the important improvement of the thermal exchanges between the combustion products and the web, the mechanical energy needed to suck and blow these combustion products is also considerably reduced.

The invention claimed is:

1. A convective system for a dryer installation arranged transversally with respect to a web to be dried, said convective system comprising an exterior casing for suction of combustion products with opening towards the web a first and second suction ducts and sucking said combustion products into said convective system said first suction duct sucking said combustion products into said exterior casing a mixing and blowing device for re-use of said combustion products, thereby mixing cold air with said combustion products resulting in a gas mixture with lower temperature an internal casing inside said external casing with at least one opening towards the web said internal casing having openings allowing gas flow from external casing to internal casing of said gas mixture a blowing duct under said internal casing wherein said second suction duct is also arranged under said internal casing said second suction duct extracting a second flow of combustion products into said internal casing said second flow of combustion products consequently being mixed with said gas mixture with lower temperature resulting in a mixture of gasses with a temperature that is higher than said first gas mixture said resulting mixture of gasses being blown to the drying web by said blowing duct.

2. A convective system according to claim 1, wherein the mixing and blowing device is a venturi.

3. A convective system according to claim 1, wherein the blowing duct is arranged between said first suction duct and said second suction duct.

4. A convective system according to claim 1, wherein said internal casing is designed in such a way as to provide a good air distribution.

5. A convective system according to claim 1, wherein the system also comprises an air pressure sensor in order to assure constant flotation effect on the web.

6. A convective system according to claim 1, wherein the system also comprises a temperature sensor.

7. A convective system according to claim 1, wherein said mixing and blowing device at least has one turbine of which the axis is substantially perpendicular to the web.

8. A convective system according to claim 1, wherein said mixing and blowing device at least has one turbine of which the axis is substantially parallel to the web.

9. A method for safeguarding a fan from contact with hot combustion gasses by using a system according to claim 1.

10. A method of re-using heated gasses to enhance the heat exchanging efficiency using the system according to claim 1.

11. A dryer installation for drying web, more particularly paper, said installation being provided for drying a maximum web width, said installation comprises gas-heated radiant elements for radiating said web, arranged according to at least one row stretching out in the transversal direction over the substantially entire maximum web width, said installation comprising at least one transversal convective system according to claim 1.

12. A dryer installation for drying web, more particularly paper, said installation being provided for drying a maximum web width, said installation comprises at least one burner assembly adapted to burn in blue flame mode for heating said web, arranged according to at least one row stretching out in the transversal direction over the substantially entire maximum web width, said installation comprising at least one transversal convective system according to claim 1.

13. Dryer installation according to claim 11, wherein said installation comprises at least two transversal convective systems arranged one after the other in the passing direction of the web and separated one from the other by at least one transversal row of heating elements.

* * * * *